US005172443A

United States Patent [19]

Christ

[11] Patent Number: 5,172,443

[45] Date of Patent: Dec. 22, 1992

[54] METHOD AND APPARATUS FOR WET-FINISHING TEXTILE GOODS

[75] Inventor: Wilhelm Christ, Michelbach an der Bilz, Fed. Rep. of Germany

[73] Assignee: Then Maschinen und Apparatebau GmbH, Hessental, Fed. Rep. of Germany

[21] Appl. No.: 665,361

[22] Filed: Mar. 6, 1991

[51] Int. Cl.[5] ..... D06B 5/18

[52] U.S. Cl. ..... 8/149.1; 8/155.1; 68/5 C; 68/189

[58] Field of Search ..... 8/149.1, 155.1; 68/5 C, 68/150, 189

[56] References Cited

U.S. PATENT DOCUMENTS

| | | | |
|---|---|---|---|
| 1,948,568 | 2/1934 | Faber et al. | 8/149.1 X |
| 3,600,731 | 8/1971 | Bergholtz | 8/149.1 |
| 3,871,821 | 3/1975 | Winn et al. | 8/149.1 |
| 4,082,502 | 4/1978 | von der Eltz et al. | 8/149.1 X |
| 4,543,676 | 10/1985 | Karrer | 8/149.1 |

*Primary Examiner*—Philip R. Coe

*Attorney, Agent, or Firm*—Frishauf, Holtz, Goodman & Woodward

[57] ABSTRACT

In a method for wet-finishing textile goods in the extraction process, the textile goods are made-up in the form of spools or in packages. They are placed in this made-up form in a vessel closable in a pressure-tight manner and the air is then at least substantially removed from the interstices in the textile goods. In the course of the method, the liquor present in the form of an aerosol is made to flow through the textile goods. In order to reduce the water and energy consumption and to also improve the quality of the treatment, the textile goods are first transferred to a state with increased temperature and low residual moisture. Subsequently or or simultaneously, the air is at least substantially removed from the interstices in the textile goods, and after this state has been attained, a gaseous medium under increased pressure which together with the liquor forms an aerosol is made to flow directly through the textile goods.

26 Claims, 4 Drawing Sheets

METHOD AND APPARATUS FOR WET-FINISHING TEXTILE GOODS

FIELD OF THE INVENTION

Figure 1:
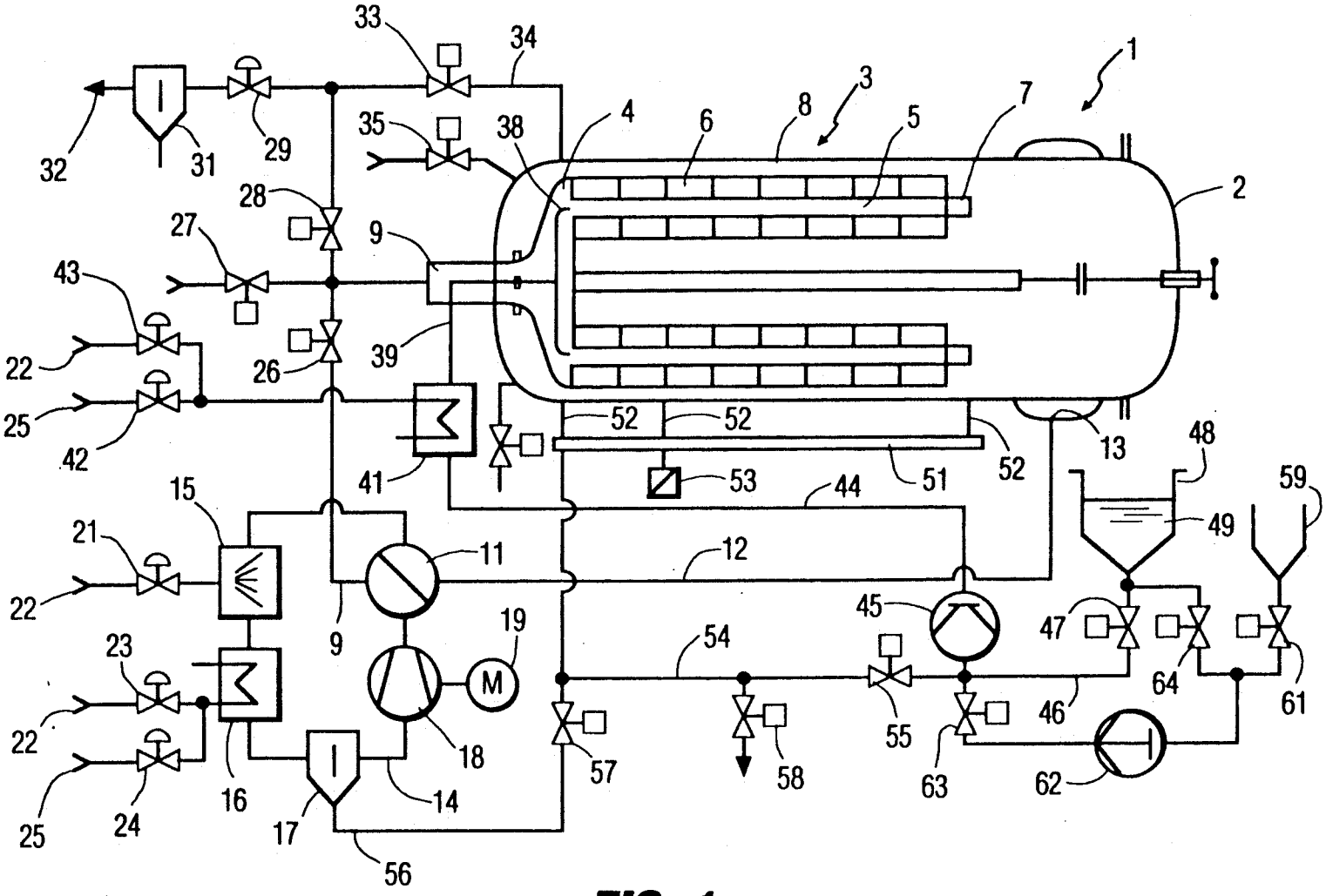

The invention relates to a method and an apparatus for wet-finishing textile goods.

BACKGROUND

A generic method for wet-finishing textile goods is known from German patent 958 914. In the performance of this method, the textile goods are placed in a vessel closable in a pressure-tight manner on a material holder, the interior of which is connected to a line which leads to the intake side of a circulating pump or a compressor. The compression side of the circulating pump is hydraulically connected via a further line to the vessel interior. Arranged parallel to this gas circulating pump serving to convey air through the textile goods located in the vessel is a liquid pump, the intake side of which is connected to a water trap connected upstream of the gas circulating pump. The compression side of the liquid pump is connected to injection nozzles arranged in the line on the compression side of the gas circulating pump.

The vessel is furthermore connectable to a vacuum source and allows the treatment liquor to be introduced via a further line.

The wet-finishing is carried out by all of the aerating valves of the vessel first being closed and the vessel then being connected to the vacuum source by an appropriate valve being opened. A line for the treatment liquor is simultaneously opened so that the developing negative pressure will aspirate the treatment liquor into the vessel and consequently into the textile goods. The treatment liquor flows in on a side of the textile goods that in the further course of the treatment process will be connected to the intake side of the gas circulating pump.

When the textile goods in the container have been flushed in this way with the liquor, the vacuum source is switched off and instead the vessel is aerated towards the atmosphere. The resulting pressure surge serves to uniformly distribute the liquor in the textile goods.

This procedure is repeated several times, and the gas circulating pump is then put into operation after the liquor has been let off. The gas circulating pump forces the air located in the system through the textile goods and hence carries the liquor along with it out of the textile goods. The entrained liquor carried out of the textile goods by the gas stream is collected in the liquid trap on the intake side of the gas circulating pump and re-introduced via the liquid pump in atomized form on the compression side of the gas circulating pump.

Owing to the initially required, complete flushing of the vessel filled with the textile goods, the treatment liquor requirement corresponds approximately to the volume of the vessel less the volume occupied by the textile goods. The requirement is, therefore, considerable and is of the order of magnitude of what is required by the conventional technique with a long bath. A drawback of this method is the re-introduction of the excessive treatment liquor which in the subsequent bleaching process has to be supplemented by the component of bleaching liquor that was absorbed by the textile goods. Herein, soiling of the repeatedly used bleaching liquid as it flows through the textile goods is unavoidable. Moreover, conversion to other finishing methods without considerable loss of bleaching liquid or to other treatment baths and the products contained therein is not feasible.

Insofar this method does not offer any significant advantages over the wet finishing with the conventional long bath.

In the wet finishing method according to German published patent application 22 62 309, a system is used which again comprises a vessel closable in a pressure-tight manner with the textile goods arranged therein. The interior of the vessel communicates via a suction line with the intake side of a gas circulating pump. The compression side of this circulating pump is connected via a line to a heating device from which a further line leads to the vessel, more particularly, into the interior of the textile goods. Further lines discharge upstream and downstream of the heating device. These are connected to a dye vat from which the dye to be applied is injected into the connection line of the heating device and the interior of the textile goods.

In the performance of the method, the gas circulating pump is started, without any further preparatory work, and thereupon forces air through the textile goods. Simultaneously, the dye to be applied is atomized downstream of the heating device and conveyed to the textile goods by the circulating air.

This method does have the advantage of low dye consumption, but a feature, in particular, of this method is uneven dyeing of the textile goods, which is due to the fact that certain regions of the textile goods present in the form of spools receive less dye than others.

The application of dressing agent to webs of fabric by means of an aerosol is known from German patent 885 534. Webs of fabric, viewed in the flow direction of the aerosol, are very thin structures and so there is no danger of air occlusions to impede application of the dressing agent.

THE INVENTION

It is an object to provide a method and an apparatus for wet finishing of textile goods which makes it possible for the textile goods to be uniformly supplied with the finishing agent even when the textile goods are present in the form of a thick, multi-layer structure.

Briefly, the textile goods, placed in a pressure vessel, are pre-treated to remove entrapped air from the textile goods. In accordance with a feature of the invention, the temperature of the textile goods is then increased and residual moisture removed, for example by dry air, so that the residual moisture will then be low. The goods should be, preferably, essentially free of entrapped air. In accordance with a feature of the invention, the temperature of the goods is raised and the goods are then subjected to an aerosol formed of treatment liquor and a gaseous medium, under pressure, that is, at a pressure in excess of that prevailing in the vessel. This aerosol is delivered under this higher pressure to one side of the textile goods so that the gaseous medium, leaving the liquor previously in the aerosol, can escape from the other side of the goods, that is, to flow directly through the goods. This step is carried out for a predetermined period of time, for example several minutes. The increase in temperature, and the decrease in moisture, can be carried out as a separate step in advance of the admission of the aerosol to the vessel to treat the goods, or simultaneously therewith. If the textile goods are temperature-sensitive, for example for goods requiring a setting temperature below about 100° C., the substantially air-free state of the textile goods can be achieved by evacuation of the vessel.

In accordance with a feature of the invention, an atomizing device generating the aerosol from a mixture of the gaseous medium and the treatment liquor is located inside the vessel, in order to ensure the degradation of the aerosol, namely that droplets in the stream of the gaseous medium recombine and drop out of the gaseous medium and thus degrade the aerosol. Placing the atomizing device within the vessel results in very short aerosol paths between the ejection nozzle end the textile goods in the vessel, so that very little fluid matter, that is, liquor, is lost from the aerosol before the aerosol impinges on the textile goods.

The substantial removal of the air from the interstices in the textile goods prevents the formation of air occlusions when the aerosol subsequently flows through the textile goods. These air occlusions would prevent the finishing agent from penetrating these regions. Owing to the low viscosity of the aerosol and, compared with the latter, the high viscosity and adherence of the liquid surrounding the air occlusion, it is also practically impossible to remove the air occlusion from the textile goods. At the same time, the air occlusion increases the flow resistance in this region of the textile goods, and this forces the aerosol to flow through in those regions in which the flow resistance is lower.

Such phenomena do not occur with single-layer textile goods and, therefore, treatment with an aerosol is readily possible in that case, however, transferral of the method to textile goods which are present in packages has so far been unsuccessful.

The method according to the invention requires very little liquor. The amount of liquor corresponds approximately to the total volume of the cavities in the textile goods. Therefore, with the method according to the invention the liquor ratio, stated in liters of liquor per kilogram of textile goods, is very favorable. The energy expenditure for the heating-up to the setting temperature is correspondingly low and the quantities of waste water produced are correspondingly small.

The textile goods are subjected to less mechanical stress because only an aerosol and not the liquor in liquid form flows through the textile goods. These retain their quality better than in the wet finishing with a liquor in liquid form.

Good results are obtained at temperatures below 100° C., for example, between 50° C. and 80° C., if the partial pressure of the air is only insignificantly greater than the steam pressure of the water at the selected process temperature which is predetermined by the respective setting temperature. The air-free state can be achieved either by previous evacuation of the container or by rinsing the system several times with superheated steam at the process temperature in order to give off as little water as possible to the textile goods.

The uniformity, in particular with very thick layers, can be improved and, at the same time, the wet finishing process shortened by the aerosol flowing through alternately from either side of the textile goods. To achieve further evening-out, the entire outer circumferential area and the entire inner circumferential area of the textile goods which are formed into a textile structure are directly subjected to the aerosol at least one after the other with respect to time. To this end, the nozzles can be moved relative to the textile goods.

Compression of the textile goods which become increasingly moist in the course of the finishing process owing to the increasing specific weight is substantially avoided in the case of textile goods present in stacks by horizontally aligning the creels on which the textile goods are located. It is also preferable for the textile goods to be set in motion about a horizontal axis in order to avoid one-sided strain and distortion in the textile goods.

In accordance with a feature of the invention, in an apparatus for performing the method the atomizing device is located inside the vessel and hence within the immediate proximity of the textile goods. In order to have these advantages for both a flow from the inside out and a flow from the outside in, the atomizing device is arranged inside the vessel partly in the material holder and partly outside the material holder.

DRAWINGS

Figure 2:
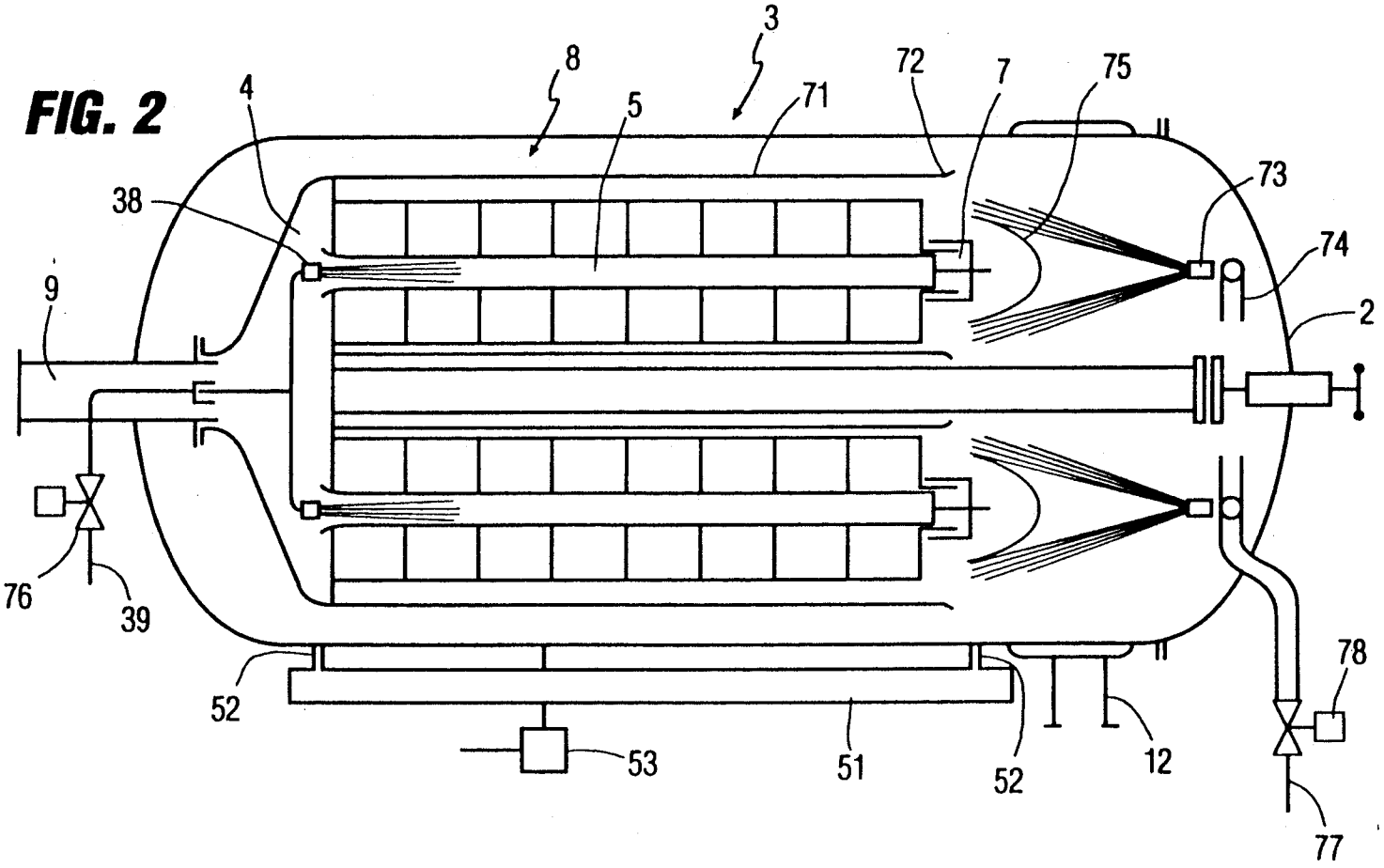
Figure 3:
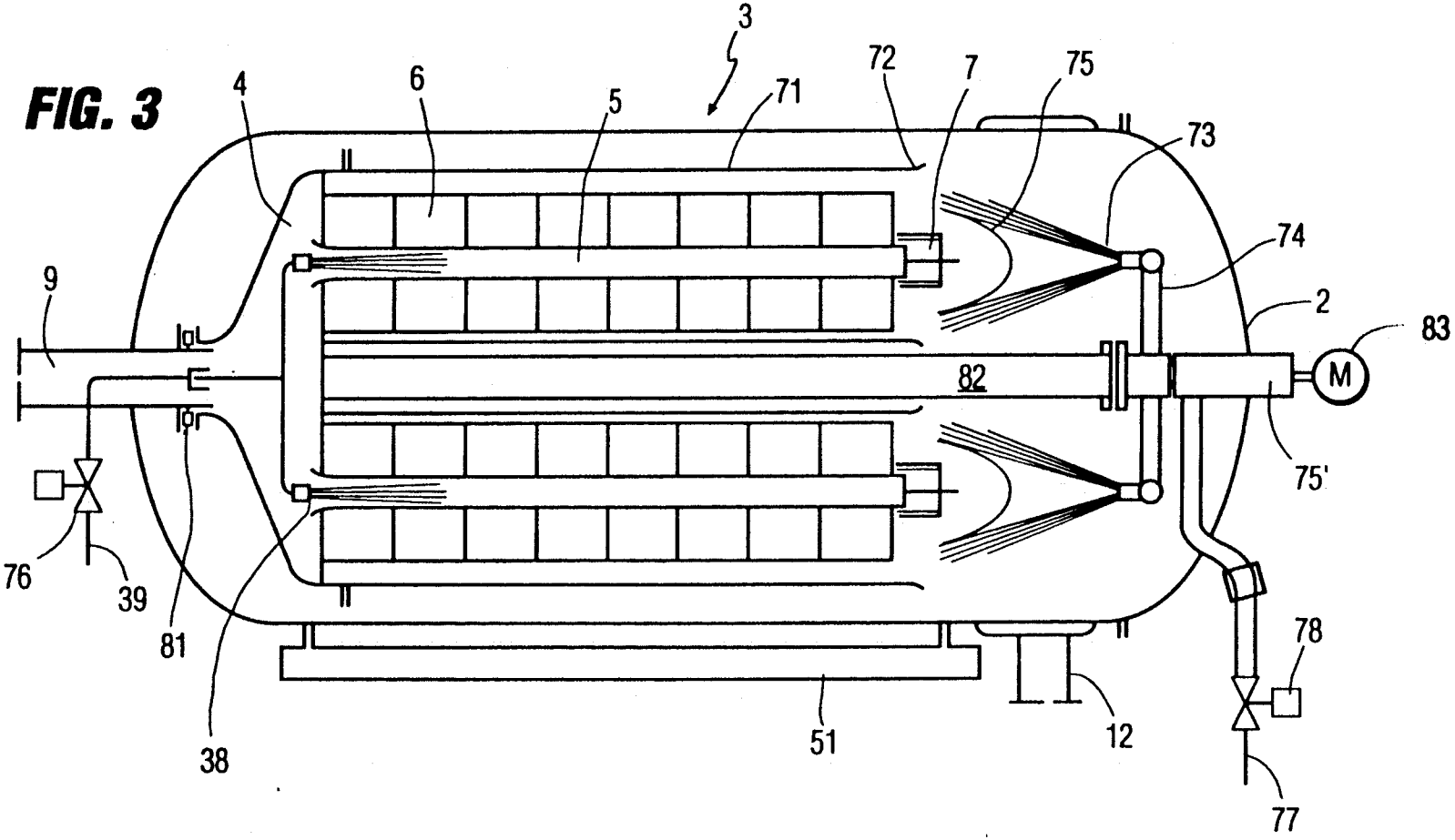
Figure 4:
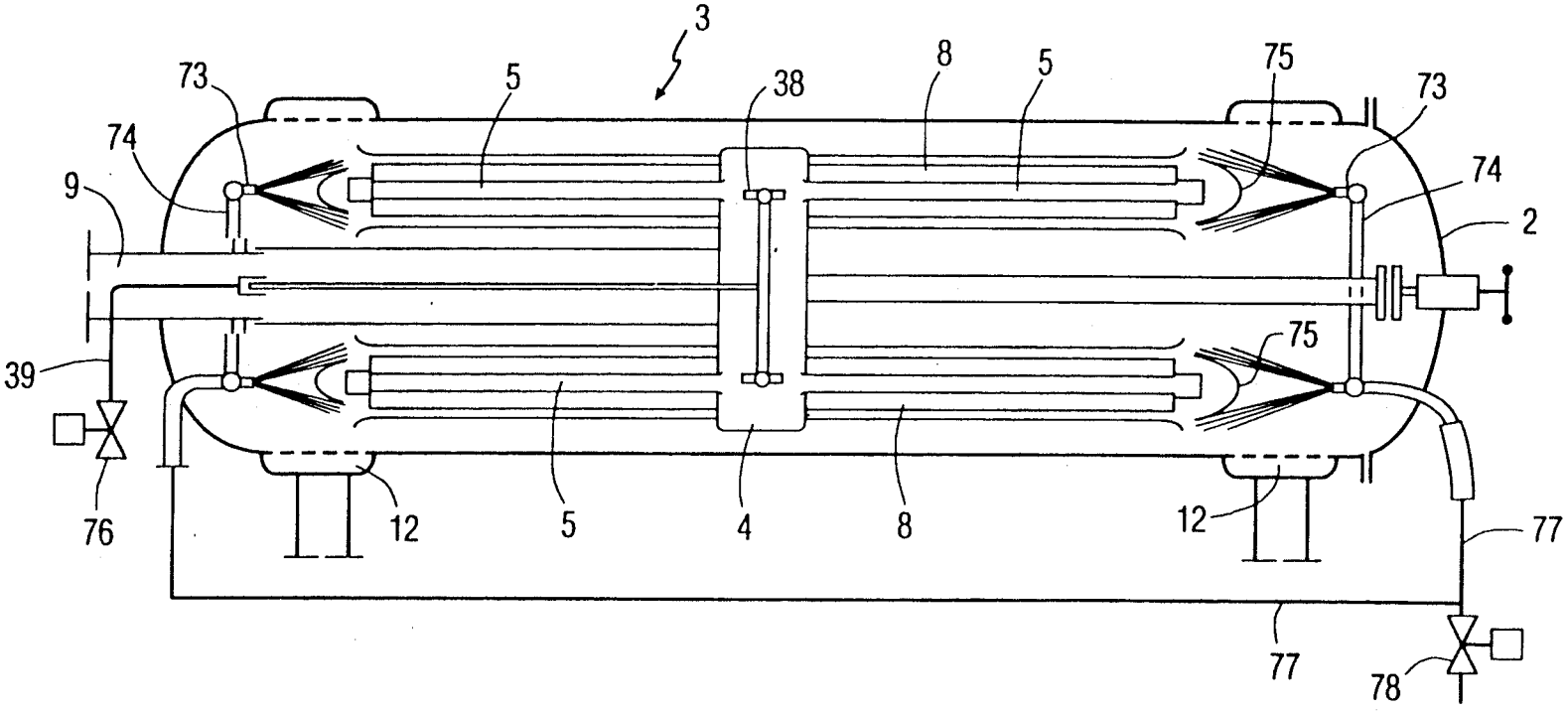

Embodiments of the subject matter of the invention are illustrated in the appended drawings which show:

FIG. 1 a schematic illustration of an apparatus for performing the method according to the invention;

FIG. 2 an enlarged illustration of the vessel of the apparatus according to FIG. 1 for a flow from the outside in and from the inside out as well;

FIG. 3 a vessel similar to that of FIG. 2 with a rotatable material holder; and FIG. 4 a schematic illustration of a vessel for a larger holding capacity.

FIG. 1 shows an apparatus 1 for the wet finishing of textile goods in stacks or packages. The textile goods are yarns, threads or slivers in the form of spools, woven fabric or knitted goods as piece-beam packages, muffs and the like. The apparatus comprises a vessel 3 which is closable in a pressure-tight manner by a lid 2 and in which a material holder 4 for the textile goods is arranged. The material holder 4 is hollow in the known manner and carries creels 5 spaced equidistantly along its circumference. The creels 5 lie horizontally and a plurality of spools 6 is placed on them in such a way as to produce several columns which lie in axially parallel relation to one another. The interior of all of the spools 6 communicates hydraulically with the interior of the material holder 4, and the thus formed cavity is closed at the end by caps 7 placed on each creel 5. All of the spools 6 are referred to hereinbelow in their entirety as textile goods structure 8.

Hydraulically connected to the material holder 4 is a line 9 via which the interior of the material holder 4 is connected to a 4/2 directional control valve 11. A further line 12 leads from the valve 11 to the vessel 3 and discharges into the latter at 13. Connected to the other two fittings of the directional control valve 11 is a line 14 containing one after the other, in relation to the flow direction of the gas circulating in it, a steam supplying device 15, a heat exchanger 16, a liquid trap 17 and a pump or compressor 18 drivable by a speed controlled motor 19. The steam supplying device 15 communicates via an adjustable valve 21 with a steam network 22 and allows steam to be selectively fed to the gas circuit. The heat exchanger 16 located downstream of the steam supplying device 15 can be used for both heating and cooling, for which purpose it is connectable by two selectively adjustable valves 23 and 24 either to the steam network 22 or to a cold water supply 25 in order to operate the heat exchanger coil in the heat exchanger 16 with the appropriate medium.

In accordance with the position of the valve 11, the gas contained in the apparatus is fed from the compressor 18, the compression side of which is connected to the valve 11, either to the interior of the material holder 4 so as to flow through the textile structure 8 from the side of the creels 5 as so-called flow from the inside out, after which the gas flows back via the interior of the vessel 3 and the line 12 to the valve 11 and hence to the intake side of the compressor 18. Or, in the position of the valve 11 other than the one shown in the drawing, the gas flows from the compression side of the compressor 18 via the line 12 into the interior of the vessel 3 so as to pass through the textile structure 8 into the interior of the material holder 4 as so-called flow from the outside in. From there the gas flows back via the line 9 to the valve 11 and then to the intake side of the compressor 18. In doing so, the gas coming from the textile structure 8 passes in succession through the steam supplying device 15, the heat exchanger 16 and the liquid trap 17.

In order to make the vessel 3, the lines 9 and 12 connected to it and the further devices connected to these substantially air-free, a number of further valves are connected to the vessel 3 and the line 9, respectively. This includes firstly a shutoff valve 26 connected upstream of the valve 11 to shut off the flow connection between the material holder 4 and the valve 11. A further shutoff valve 27 connected to the section of the line 9 that lies between the shutoff valve 26 and the material holder 4 permits aeration of the apparatus; the other fitting of the shutoff valve 27 leads into the open. Finally, there is connected to this section of the line 9 between the shutoff valve 26 and the material holder 4 a shutoff valve 28 which connects the line 9 with a negative pressure control valve 29 which leads to a water trap 31 and further to a vacuum source 32. The vacuum source 32 is, for example, a water ring pump with a supply tank, a jet pump or some other suitable pump which allows the air to be aspirated out of the apparatus 1.

After the shutoff valve 28 has been opened, the air is aspirated from the vessel 3 via the material holder 4 as a flow from the outside in at the textile goods structure 8. A shutoff valve 33 is provided in order to also have the possibility of evacuating the air as flow from the inside out. This shutoff valve 33 is connected via a line 34, on the one hand, directly to the interior of the vessel 3 and, on the other hand, to the connection line between the control valve 29 and the shutoff valve 28. When the shutoff valve 28 is closed, the air can be aspirated as flow from the inside out via the opened valve 33. Since the volume in the material holder 4 and in the line section as far as the shutoff valve 26 is small, during the evacuation via the valve 33 practically no flow of air will occur in the textile structure 8, whereas, contrarily, in comparison with that, during the evacuation via the valve 28 a relatively large amount of air will be drawn through the textile structure 8. Depending on the material properties and moisture content of the textile structure 8, the one or the other variant will prove expedient.

Finally, there is also connected to the vessel 3 a shutoff valve 35 which leads into the open and enables the vessel 3 to be brought to atmospheric pressure again, more particularly, without an excessively strong flow through the textile structure 8 because the inflowing air travels directly into the interior of the vessel 3.

The sensors for temperature, pressure and moisture contained in the lines explained hereinabove are customary in apparatus of the kind described herein, and it is known at which point it is expedient to arrange them. For reasons of simplicity, these sensors have been omitted from the drawing, as has the central control means for starting in a remote-controlled manner the various electric operating means of the valves and motors 19.

As is evident, the apparatus 1, insofar as described hereinabove, essentially resembles so-called pressure dryers and, in practical application, it is expediently extended by those components which are necessary in pressure dryers such as compressed air sources and the associated valves. It differs from pressure dryers, on the one hand, in that there is the possibility of evacuation and, on the other hand, with respect to the devices described hereinbelow for introducing the liquor required for the wet finishing into the gas circuit. To facilitate comprehension and simplify the drawing, it will be assumed that the liquor present in the form of an aerosol flows through the textile structure 8 as flow from the inside out. For this purpose, a number of atomizing nozzles 38 are located in the material holder 4. These are positioned in the material holder 4 in the proximity of the foot of each creel 5. The atomizing nozzles 38 are connected to a line 39 which extends within the material holder 4 and to some extent within the line 9 before being led out in a sealed-off manner. The line 39 connects the nozzles to a heat exchanger 41 which, similarly to the heat exchanger 16, can be used selectively for cooling or heating. For this purpose, it is selectively connectable to the steam source 22 or the cold water means 25 via two adjustable valves settable from zero on. From the heat exchanger 41 there leads a line 44 to the compression side of a liquid pump 45 which allows liquid to be fed under high pressure into the line 44 and hence to the atomizing nozzles 38. The intake side of the liquid pump 45 is firstly connected via a line 46 and a valve 47 which can be selectively shut off to a storage container 48 for the liquor 49 kept therein. When the valve 47 is open, the pump 45 can aspirate the liquor 49 from the storage container 48.

The aerosol generated in this way travels through the gas circulated by the compressor 18 into the textile structure 8. Part of the liquid transported in this way will remain in the pores of the textile structure 8 where the transfer of the substance from the liquor to the textile goods as is customary in the extraction process then takes place. Another part of the liquor will be transported with the circulating gas stream through the textile structure 8 and emerge again on the side of the textile structure 8 on which the liquor flows off. In the case of the flow from the inside out, this component of the liquor will partly condense on the inside of the vessel 3 and collect at the lowest point. A further part will flow off with the circulating gas via the line 12 and travel to the liquid trap 17 and the intake side of the compressor 18, respectively. To enable further use of the liquor present in liquid form, there is arranged below the vessel 3 a collecting line 51 which communicates via several short lines 52 with the vessel 3. The collecting line 51 is dewatered via a line 54 and a shutoff valve 55 leading to the intake side of the liquid pump 45. The dewatering is controlled via a level regulator 53. The liquor present in the liquid trap 17 is likewise fed back into the line 54 via a line 56 and a shutoff valve 57.

After termination of the wet finishing process, the liquor is let off via a drain valve 58 which is connected to the line 54 and can be shut off.

If certain substances have to be added in the course of the wet finishing process, for example, to change the pH value, a supplementary container 59 which is connected via a shutoff valve 61 to the intake side of a metering pump 62 is provided. The metering pump 62 feeds at its compression side via a shutoff valve 63 the liquid from the supplementary container 59 to the suction side of the liquid pump 45.

The circuit for the liquor also contains a number of pressure and temperature sensors for regulating and controlling the process. For reasons of simplicity, these additional sensors have likewise been omitted from the drawing.

With the apparatus 1 described hereinabove for the wet finishing, the amount of liquor required results essentially from the interstice volume or pore volume of the entire textile structure plus the amount circulating freely in the remaining gas stream and condensed on the line and container walls, respectively. This amount is considerably less than the amount required for the so-called short bath technique wherein the liquor is forced in liquid form through the textile structure 8.

If, for example, a cotton cross-wound bobbin with 1.2 kg dry weight has a spool density of 0.38 kg per liter spool volume, this amounts to a spool volume of 3.16 l. With the specific weight of the cotton being 1.5 kg/l, in this example the volume component of the cotton is 0.8 l and so the entire interstice or pore volume amounts to 2.36 l. Hence the maximum liquor charge is 2.36 l per bobbin in accordance with a liquor ratio of 1:1.97, i.e., for 1 kg textile goods with 100% liquor absorption, a bath volume of 1.97 l is required.

During the finishing process, however, the liquor ratio is somewhat lower for part of the interstice volume in the textile structure is taken up by the gas flowing through it.

For uniform dye distribution and in fiber-dye systems in which a substantivity to the dye already exists in this phase of the bath distribution, rapid loading of the textile structure 8 is necessary. This loading operation is to be equated with a 100% wetting with the liquor. To achieve this, prior to the introduction of the liquor in aerosol form, the air component in the entire apparatus is reduced either by evacuation or by rinsing with superheated steam. Which of the two method steps is used to reduce the air component depends on the required fixing temperature, as will become evident from the embodiments hereinbelow. Favorable results are achieved if the partial pressure of the air does not exceed 200 hPa.

If the textile goods do not exhibit the correct temperature and moisture prior to commencement of the wet finishing, they can be conditioned in the known manner in the apparatus 1. A necessary heating-up with minimum condensate moistening can, for example, be achieved if with the aid of the compressor 18 air heated in the heat exchanger 16 is passed through the textile structure and subsequently fed back to the intake side of the compressor 18. The textile goods can also be heated by superheated steam which likewise does not give off any moisture to the textile goods. In this case, the parameters of the steam must be selected such that the steam is still in the superheated state after flowing through the textile structure 8.

Operation

The apparatus 1 described hereinabove is operated as The lid 2 of apparatus 1 is opened and the textile goods attached to the creels 5 are placed in the vessel 3. The lid 2 is then closed and the compressor 18 serving to circulate the gas is started. In this operating state, all of the valves with the exception of valve 26 are first closed. In accordance with the position of the directional control valve 11, the gas pumped by the compressor 18 first flows through line 9 or line 12 to then flow through the textile structure 8 as flow from the inside out or from the outside in. The gas flows off via the respective other line 12 or 9 first to the steam supplying device 15, then to the heat exchanger 16, after that to the liquid trap 17 and back again to the compressor 18 which pumps the gas into the textile structure 8 again. In this operating state, the liquid pump 45 is initially still switched off.

By opening the control valve 29 and the shutoff valves 28 or 33 and the control valves 21 or 23 and 24, respectively, the moisture and temperature of the circulating air can be adjusted so as to bring the textile structure 8 into the desired thermodynamic state.

If steam is to be worked with instead of air, the gas located in the apparatus 1 is let off by opening the valve 35 several times and steam is simultaneously introduced by opening the control valve 21. In this way the apparatus 1 is rinsed with steam, and the air component decreases with each rinsing procedure.

After the respectively required temperature and moisture state has been attained in the textile structure 8, either by opening valves 33 or 28 and valve 29 the air pressure is first lowered to under 200 hPa or in the case of conditioning with steam the liquid pump 45 is started immediately. With valve 47 open, it aspirates the prepared liquor 49 from the storage container 48 and feeds it under high pressure to the atomizing nozzles 38. The liquor emerges at the atomizing nozzles 38 in the form of fine or extremely fine droplets and forms together with the gas circulated by the compressor 18 an aerosol which flows through the textile structure 8 as flow from the inside out. The liquor flowing through line 44 can be adjusted to the required temperature in the heat exchanger 41 by either control valve 42 or control valve 43 being opened, depending on whether cooling or heating of the liquor is necessary.

After the necessary amount of liquor has been transferred from the storage container 48 to the gas circuit, valve 47 is closed. Valve 55 is now opened so that the liquid pump 45 can again aspirate the liquor present in liquid form in the collecting line 51 and atomize it via the atomizing nozzles 38. The liquor present in the liquid trap 17 can also be selectively fed to the intake side of the liquid pump 45 by opening valve 57. In this way, two circuits are created, more particularly, a gas-aerosol circuit which leads via the compressor 18 and a circuit in which the liquor undergoes a change in state from the liquid to the aerosol form and back. The latter circuit contains the liquid pump 45 which brings the liquor present in liquid form back into the gas-aerosol circuit.

Regulation of the wet finishing process in the sense of keeping the process temperature constant can be carried out via the heat exchangers 16 and 41, i.e., by acting upon the gas-aerosol circuit or upon the "liquor circuit", with only the temperature of the liquor present in the liquid form being influenced.

EXAMPLE 1

In a horizontal dyeing apparatus of the type of design shown in FIG. 1, six tubular creels each with a diameter of 70 mm are arranged on the material holder 4. The tubular creels are supplied with six polyester muffs with a single weight of 2.5 kg as pressed columns on spring wire sleeves. The density of the thus produced spool with a spool diameter of 240 mm and a pressed column height of 955 mm is 0.380 kg/l spool volume. The polyester threads are texturized with a fineness dtex 167 f 32×1.

After loading of the vessel 3 has been completed, the textile structure 8 is prepared for the wet finishing process.

On the basis of the density of the polyester material of 1.38 kg/l and the spool density of 0.38 kg/l there is an interstice volume of 170 l. A 2% red coloring with a disperse dye is prepared. Since it is expedient in the new method technology for the entire treatment liquor to be distributed within as short a time as possible in the textile structure 8, a low initial moisture of the fiber material and a low air density or only a steam density corresponding to the treatment liquor temperature should prevail. To achieve a low initial moisture, the textile structure 8 is heated in a first treatment step with dry air, for example, to a fiber temperature of 110° C. The heating-up to the treatment temperature is carried out with superheated steam, and a substantial reduction of the air component present in the entire system and in the textile structure 8 is thus to be achieved. This is done in the manner mentioned hereinabove by alternate opening of valves 21 and 35 until the desired state is attained in which almost air-free steam is circulated in the gas circuit by the compressor 18. The time required for this state to be reached, with a treatment temperature of 130° C. corresponding to the fixing temperature of the disperse dye, depending on the geometrical dimensions of the spools 6, the fineness of the threads or yarns, the yarn construction or the spool density is approximately 5 minutes. A 2% red coloring of the following composition is provided for the liquor:

2% commercially available disperse dye 0.3% auxiliary levelling agent on the basis of a high-molecular polyester containing a sulfo group pH 4.5 with acetic acid and 1.5 g/l sodium acetate.

The preparation is heated to 80° C. and filled into the storage container 48 in an amount of approximately 150 l. After valve 47 is opened, the liquor in the container 48 is aspirated by the liquid pump 45 and fed to the atomizing nozzles 38, with the liquor being heated to the fixing temperature of 130° C. in the heat exchanger 41. The liquor emerging from the atomizing nozzles 38 in the form of extremely fine droplets is transported by the gas constantly circulating in the gas circuit into the spool structure 8 and through the latter. The major part of the liquor present in fine droplets is directly absorbed by the textile structure. The textile structure 8 is thereby completely charged with the liquor within a very short time, while being subjected to low mechanical stress, for the interstices in the textile structure 8 are air-free.

Liquor present on the side of the textile structure 8 on which it flows off, insofar as the droplet size has become too large and the droplets no longer remain suspended, collects in the collecting line 51 or the trap 17.

Once the liquor preparation is in the circuit, valve 47 is closed and instead valve 55 or valve 57 is opened in order that the liquor extracted from the gas-aerosol circuit will be atomized again. This procedural step lasts until the desired exhaustion of the bath is achieved. After an additional setting time of 10 minutes, the liquor is let off and the pressure is simultaneously reduced and the textile structure 8 cooled down, during which the liquor charge is reduced. To remove dyestuffs which are not set in the textile structure 8 and to achieve the necessary fastness of the dyeing, a cleaning solution is introduced from the container 59 by opening valve 61 and switching on pump 62. The temperature of this cleaning solution is approximately 85° C.

The cleaning solution consists of the usual quantities of soda lye, hydrosulphite and auxiliary agents.

The cleaning solution which is likewise present in the form of an aerosol is circulated for approximately 5 minutes, with the temperature of the cleaning solution being regulated at the heat exchanger 41 via the two control valves 42 and 43. After completion of the cleaning, the cleaning solution is removed from the apparatus 1 via the drain valve 58 with the liquid pump 45 being switched off. There is the additional possibility of further reducing the component of treatment liquor held in the textile structure 8 by switching valve 11 over to a flow from the outside in and of simultaneously increasing the rotational speed of the compressor 18. The thereby pressed-off component of liquor is removed in the liquid trap 17 upstream of the intake side of the compressor 18.

After this treatment step the textile structure 8 is rinsed using the liquor system, more particularly, with a rinsing water preparation, for example, with 170 l rinsing water at 60° C. The rinsing water is heated in the heat exchanger 41 in a regulated manner to 85° C. and atomized via the atomizing nozzles 38. Valve 11 had again been previously switched over to a flow from the inside out.

After introduction of the rinsing water, the liquid pump 45 is stopped again and the rinsing water let off via the opened valve 58. Removal of the rinsing water is promoted by switchover to the flow from the outside in.

The procedural step with the rinsing water aerosol is performed two more times, after which rinsing with soft water at approximately 20° C. is carried out likewise using an aerosol. The time for such a repeat is approximately 3 minutes and so the entire wet finishing takes approximately 45 minutes. The total water consumption for a liquor preparation for the dyeing, a preparation for the reductive cleaning and for a total of four rinsing baths is 1020 l corresponding to a specific water consumption of 11.3 l/kg textile goods.

FIG. 2 shows a further embodiment of the vessel 3 with which it is possible to also conduct the aerosol through the textile structure 8 in a flow from the outside in. Those components already described hereinabove have the same reference numerals and are not explained in detail again.

The vessel 3 according to FIG. 2 additionally comprises on each creel 5 a tubular jacket 71 which concentrically surrounds the associated creel 5 and is attached at one end to the material holder 4.

At its end remote from the material holder 4, each tubular jacket 71 widens slightly, as shown at 72, in the shape of a funnel. Arranged in alignment with each tubular jacket 71 in the vessel 3 is a further atomizing nozzle 73 which is supplied from a ring line 74 located in the vessel 3 opposite the respective funnel-shaped widening 72 of the tubular jacket 71.

To prevent unnecessary loss of aerosol at the caps 7, each cap 7 is covered by a conical hood 75, the tip of which faces the associated atomizing nozzle 73. The holder for the covering hoods 75 is not shown in detail.

The tubular jacket 71 produces around each column comprised of stacked spools 6 a ring gap into which the nozzles 73 spray a hollow conical jet.

To enable selective use of the set of atomizing nozzles 38 or atomizing nozzles 73 depending on whether a flow from the inside out or from the outside in is used, a further shutoff valve 76 is provided in the supply line 39. There also leads from the flow-off side of the heat exchanger 41 where the line 39 is connected a line 77 to a shutoff valve 78 which supplies the ring line 74.

In accordance with the position of the valve 11 for the flow from the inside out or the flow from the outside in, the valve 76 is closed and the valve 78 opened or vice-versa the valve 78 closed and the valve 76 opened.

Use of the vessel 3 of such design is described hereinbelow with reference to Example 2:

EXAMPLE 2

The textile goods correspond in the substrate, in the make-up and in the arrangement on the material holder 4 to Example 1, but instead of vessel 3 from FIG. 1 that of FIG. 2 is used.

A trichrome dispersion dyeing is carried out with a color combination of yellow, red and blue which are combined with one another to produce a grey tone with a total concentration of 1.7%.

The liquor contains:

1 g per 1 dispersing agent,
0.6% auxiliary levelling agent on the basis of a high-molecular polyester containing a sulfo group,
pH 4.5 with acetic acid and 1.5 g/l sodium acetate,
0.1% yellow disperse dye,
0.4% red disperse dye,
1.2% blue disperse dye,
1 g per 1 auxiliary agent for regulating the pH values (for example, 55% acetic acid).

The dry heating of the textile structure 8 is carried out as in Example 1. A liquor ratio of approximately 1:2 is chosen for the treatment liquor. With a textile goods charge of 90 kg, this corresponds to a treatment liquor volume of 180 l. 150 l are filled with the indicated substances, except for the dye preparation, into the storage tank 48 and heated up to 80° C. As previously, the liquor is then introduced via the liquid pump 45 into the circuit, and it is heated to the setting, or, fixing temperature in the heat exchanger 41. The volume flow generated by the compressor 18 is adjusted to one range via the rotational speed regulation in order that the liquor charge will reach the predetermined value of 85%. Since slight condensate formation occurs when a saturated steam state is reached, the atomizing of the liquor, i.e., the aerosol formation can be maintained via the return line 54. During the compensating time for the distribution of the preliminary liquor of approximately 3 minutes, the predispersed dye is prepared, proportionally relative to 20 l, and injected with the aid of the metering pump 62 within 5 minutes into the circuit. During this time, the gas-aerosol circuit is respectively switched over in the manner described hereinabove in synchronism with the injection flow so the process runs constantly in succession with a flow from the outside in and from the inside out. The cycle time is one minute.

The absorption phase is continued with the same switch-over cycle at 130° C. for 5 minutes. This is followed by a 10-minute fixing time.

The dyeing is then completed as in Example 1. The total time expenditure for the dyeing is approximately 50 minutes.

In the case of sensitive spools, it may prove expedient to allow the textile structure 8 to rotate at a slow speed in order that it will not undergo uneven deformation under the influence of gravity and that the liquor charge will also be maintained symmetrically in the spool 6. A pressure vessel suited for this purpose is shown in FIG. 3.

In the pressure vessel shown in FIG. 3, the material holder 4 is rotatably connected via seals 81 to line 9 and line 39, respectively. It also carries a drive shaft 82 which extends parallel to the creels 5 and is led out in a sealed-off manner on the side of the lid 2 and is rotationally fixedly coupled with a drive motor 83 on the outside of the vessel. Also seated on the drive shaft 82 extending coaxially through the vessel 3 is the ring line 74 which communicates with the line 77 via a rotatable connection piece 75. As a result of this, the nozzles 73 move synchronously with the creels 5 and the alignment between the atomizing nozzles 73 and the respective tubular jacket 71 is maintained.

For reasons of simplicity, the mechanical couplings required to open the lid 2 have been omitted.

EXAMPLE 3

A 2.5% reactive dyeing is carried out on cotton yarn 50/1 metric yarn count. Twelve tubular creels 5 with an outer diameter of 68 mm are located on the material holder 4. There are wound on each tubular creel 5 seven cylindrical spools with a length of 6" on axially flexible spring wire sleeves of 140 mm unpressed creel height which are pressed together to 125 mm, which results in a pressed column length of 875 mm plus the length of the caps 7. With an outer spool diameter of 140 mm, the volume of the spool is 3.06 l, which with a specific weight of the cotton of 1.5 kg/l at 1.2 kg dry weight amounts to a substrate volume of 0.8 l. This results in a total interstice volume of 2.26 l. This theoretical volume is available for the liquor charge, but a 100% filling-up of the interstice volume is practically impossible to achieve for there is a dependency between the amount of gas flowing through and the liquor charge. These two parameters behave in opposition to one another. The above-mentioned switchover of the gas-aerosol flow and of the liquor injection in accordance with the flow direction to a flow from the outside in and from the inside out, respectively, promotes the uniform dyeing of the spools in all positions. The frequency of such a switchover can be considerably higher than in finishing processes in which the textile goods are flooded. Switchover times of from approximately 2 sec can be used with the new method.

A constant temperature of 50° C. with the following composition is chosen for the dyeing:

2.5% reactive dye,
1 g/l auxiliary wetting and dispersing agent,
20 g/l sodium chloride,
6 ml/l soda lye (32.5%)
32.5% (38° Bé).

With an interstice volume of 2.28 l per spool, the interstice volume available with 84 spools is 190 l. A charge of approximately 80% corresponding to 152 l is used, and 150 l are prepared. With a predetermined total treatment liquor amount of approximately 163 l, approximately 3.3 kg salt is required. With a saturated solution of 360 g/l, this requires a volume of approximately 9 l.

After the material holder 4 has been driven in and the vessel 3 closed, the textile structure 8 is prepared by evacuation. To this end, the vessel 3 is evacuated via the negative pressure control valve 29 with shutoff valves 28 and 33 open until a pressure of approximately 0.123 hPa is reached. This pressure corresponds to the saturation pressure of the treatment liquor at 50° C. When the pressure has been reached, valves 28 and 33 are closed and so, as before, there is a circuit system which is closed in itself. By switching on the compressor 18, the remaining gas still present is circulated through the textile structure 8. If an increase in temperature occurs, which involves a rise in pressure, the pressure is re-regulated via valve 29 with valve 28 or 33 open. The evacuating and tempering of the textile structure 8 requires a time of approximately 5 minutes.

The liquor with a preparation volume of approximately 150 l is injected into the gas circuit within a time of 5 minutes via the atomizing nozzles 38 at a rate of 2.5 l/min. During this time, the compressor 18 remains switched on and, as before, constantly circulates the rarefied air in the circuit. After the entire liquor has been introduced, the flow quantity is enlarged by increasing the rotational speed of the compressor 18. Owing to the now increased volume flow, the liquor charge is reduced to a flow-pressure-dependent value, for example, by approximately 5%. The resulting excess liquor is re-introduced via the collecting line 51 and the open valve 55 to the intake side of the liquid pump 55 and hence likewise kept in the circuit. Via the heat exchanger 41 the liquor is regulated to a constant temperature of 50° C. and, as before, in conjunction with FIG. 2, the flow direction is changed several times in synchronism with the direction of injection of the liquor. The pressure on the intake side of the compressor 18 is likewise kept at a constant value, more particularly, in the range of 0.123 hPa. Hence via the saturation pressure there exists a thermodynamic state of balance between the liquor and the gas which in this case is air at low pressure and steam at 50° C.

This method step lasts approximately five minutes, with the flow direction being switched over ten times. The metering of the salt is then carried out from the supplementary container 59 by means of the metering pump 62. With valve 63 open, the salt solution is added at a rate of 1.8 l/min, more particularly, with the flow direction likewise being switched over several times in the textile structure 8. Finally, the alkali is also added from container 59 in an amount of 0.6 ml/l liquor=approximately 0.975 l of a 32.5% soda lye corresponding to 38° Bé. The lye is diluted to a volume of 3.5 l and added to the circulating liquor at a metering rate of 350 ml/min via the pump 62. This corresponds to a metering time of 10 minutes, with the flow direction being switched over ten times in the textile structure 8. The setting phase is then continued at a constant temperature of 50° C. for a time of 15 minutes.

During this, the liquid pump 45 keeps injection of the liquid extracted from the aerosol going.

To achieve optimum setting results, it may be expedient to extend the metering time to, for example, 30 minutes, with the reaction time thus being extended in parallel with this.

After the dyeing, the drain valve 58 and the aerating valve 35 are opened in order to reduce the liquor charge in the textile structure 8 by means of a flow from the inside out while the compressor 18 is running. The first rinsing bath is then atomized from the storage container 48 via the nozzles 38 with the flow from the inside out switched on. Acetic acid for acidification is simultaneously added in a metered manner from the supplementary container 59 to the second rinsing water.

The rinsing water and the gas stream are heated up via the heat exchangers 16 and 41 to the treatment temperature of approximately 95° C. Rapid carrying-off of the reactive dye hydrolysate to be absorbed by the rinsing water and of the dyes not fixed by the fibers is thereby achieved.

The total treatment time in Example 3 is approximately 80 minutes with a total water consumption of approximately 25 l/kg cotton.

It will be understood that the appropriate valves are opened and closed in order to maintain the respective gas and liquid flows. In order not to unnecessarily overload the specification, details thereof are not given herein. It will be clear from the illustration of the method and from the individual Examples which valves have to be opened and closed.

Finally, FIG. 4 shows a vessel 3 containing a material holder 4 on which creels pointing towards opposite ends of the vessel 3 are arranged on both sides. In other respects, the arrangement corresponds to the embodiment according to FIG. 2 and, therefore, insofar the same reference numerals are used. In accordance with the amended embodiment of the material holder, two ring lines 74 and two sets of atomizing nozzles 73 are provided.

In the embodiments shown herein, the nozzles 38 and 73 are arranged in the region of the end faces of each column-shaped textile structure 8. The nozzles are at rest with respect to the textile structure 8. Instead of this arrangement, it is also possible to arrange the nozzles in a line at the vertical level of each textile structure 8 and to move the textile structure 8 and the nozzles thus arranged at the side thereof relative to one another. In this way, the aerosol jet hits the entire circumferential area of the textile structure 8 uniformly.

I claim:

1. Method for wet-finishing textile goods in an exhaustion process, wherein the textile goods have low residual moisture and are made up in the form of spools or in packages, and placed in a vessel, closable in a pressure-tight manner, and the goods are subjected to a finishing treatment liquor, which is caused to flow through the textile goods in the vessel, said method comprising the steps of raising the temperature of the goods above ambient or room temperature;

substantially removing air from interstices of the textile goods until the goods have achieved essentially air-free state; and applying an aerosol which comprises a gaseous medium and the treatment liquor dispersed therein at a pressure in excess of the pressure prevailing in the vessel to one side of the textile goods, the gaseous medium developing a higher pressure on one side of the textile goods than on the other side thereof, so that the gaseous medium of the aerosol will flow directly through the goods for a predetermined period of time.

2. The method of claim 1, wherein the step of substantially removing air from interstices of the textile goods is carried out simultaneously with the step of applying the aerosol of gaseous medium and liquor to the goods.

3. The method of claim 1, wherein the step of substantially removing air from interstices of the textile goods is carried out in advance of the step of applying the aerosol of the gaseous medium and the treatment liquor to the textile goods.

4. The method of claim 1, wherein, for textile goods having a setting temperature below about 100° C., the step of substantially removing air from the interstices of the textile goods comprises evacuating the vessel.

5. The method of claim 4, wherein the pressure level within the vessel is equal to or up to 20% above the vapor pressure of water at the setting temperature.

6. The method of claim 1, wherein, for textile goods having setting temperatures above about 100° C., the step of removing air from said textile goods comprises admitting steam into the pressure vessel.

7. The method of claim 6, wherein the temperature of the steam corresponds approximately to the setting temperature.

8. The method of claim 6, wherein the steam is superheated steam of a temperature sufficiently high to remain superheated after flowing through the textile goods.

9. The method of claim 1, including the step of maintaining the temperature of the textile goods during the step of applying the aerosol to the textile goods at least approximately constant at a level which is within the range of the setting temperature of the finishing liquor in the textile goods.

10. The method of claim 1, wherein the step of applying the aerosol to the textile goods comprises applying the aerosol first to one side of the goods and then to another side of the goods, so that said aerosol will flow through the textile goods, alternatively, from both sides.

11. The method of claim 10, wherein said textile goods form textile structures which have a cavity or hollow space internally of the structure; and wherein said step of applying the aerosol comprises applying said aerosol, alternatively, to the outside of said structure to flow inwardly towards said cavity, and from the inside to the textile goods to flow outwardly through said textile structure.

12. The method of claim 11, wherein said step of applying the aerosol, alternately, from the inside towards the outside and from the outside towards the inside, of said textile structure, comprises temporally subsequently applying the aerosol to the entire outer circumferential surface of said structure and, respectively, the entire interior surface of the structure, defining said cavity, or hollow space.

13. The method of claim 1, wherein the step of applying the aerosol includes the step of generating said aerosol by atomizing the treatment liquod by said gaseous medium, and carrying out said aerosol generating step within the vessel, in the immediate vicinity of the textile goods therein.

14. The method of claim 13, wherein said step of applying the aerosol from a nozzle comprises relatively moving the textile goods relative to the nozzle.

15. The method of claim 1, wherein said goods are formed as textile structures of essentially tubular shape, defining an axis of rotation, said structures being located horizontally with an essentially horizontal axis of rotation.

16. The method of claim 15, wherein said step of applying the aerosol includes rotating said tubular structure about said axis of rotation.

17. Apparatus for wet-finishing textile goods (8), comprising a vessel (3) closable in pressure-tight manner;

support means (4) for supporting the goods (8) located within the vessel forming a material holder;

a pipe line system (9, 11, 12, 13);

gas pressure generating means (18), said pipe line system including a first connecting line (12) connecting the interior of the vessel to said gas pressure generating means (18) at one terminal side thereof; and a second connecting line (9) connected to the interior of said vessel and coupled to the support means (4) and connected to said gas pressure generating means (18) at another terminal side thereof;

temperature controlling means (15, 16) coupled to be pipe line system to control the temperature of the gas therein;

humidity or moisture controlling means (17) coupled to the pipe line system to control the moisture of the gas flowing in the pipe line system;

a pressurized finishing liquid supply means (45–48);

an atomizing device (38, 73); and a coupling connection (44, 39) from the pressurized finishing liquid supply means (45–48) to the atomizing device (38, 73), wherein said atomizing device comprises an atomizing nozzle located within the vessel (3), said pipe line system, said gas pressure generating means and said vessel forming a closed loop pressurized gas circuit, whereby pressurized treatment liquor atomized by said atomizing nozzle to form fine droplets will, in combination with the gas circulated in said closed loop, form an aerosol which will flow through the textile structure.

18. The apparatus of claim 17, further including a flow direction valve (11) included in said pipe line system (9, 12, 13) and positioned for selectively causing pressurized gas from said gas pressure generating means to flow, selectively, from the second connecting line coupled to the support means towards one side of the textile goods (4) on the support means and then return to the first connecting line (12) or to flow, first, through the connecting line to the interior of the vessel, through the textile goods, and return through the second connecting line (9) coupled to the support means (4).

19. The apparatus of claim 17, wherein said atomizing nozzle (73) is located outside of the material holder.

20. The apparatus of claim 17, wherein said material holder includes a structure defining an interior cavity or hollow space; and wherein said atomizing nozzle is located within said cavity or hollow space, whereby the atomizing nozzle will be placed at the inside of textile goods surrounding said cavity or hollow space.

21. The apparatus of claim 17, wherein said atomizing nozzle (38) comprises a plurality of nozzle elements.

22. The apparatus of claim 17, wherein the material holder (4) comprises at least one creel (5) for the textile goods (8);

a tubular jacket (17) of approximately the same length as the creel (5) is provided surrounding the jacket;

wherein the internal diameter of the tubular jacket (71) is greater than the external diameter of a column of textile goods (8) formed on the creel (5), and wherein the atomizing device (73) is arranged at the end of the tubular jacket (71) opposite the material holder (4) in the axial extension of the creels (5).

23. The apparatus of claim 17, wherein two atomizing nozzles (38, 73) are provided, located in the material holder (4) and outside the material holder (4), respectively, and valves (76, 78) are coupled to the nozzles and the pressurized finishing liquor supply means for, selectively, controlling supply of liquor to that atomizing nozzle (38, 73) which is located on that side of the textile goods (8) on which the higher aerosol pressure prevails during the flow thereof through the textile goods (8).

24. The apparatus of claim 17, characterized in that at least part of the material holder (4) receiving the textile goods (8) is rotatably mounted in the vessel (3), and wherein a drive device (83) is provided for setting the material holder (4) in slow rotational movements.

25. The apparatus of claim 17, further including a heat exchanger (41) coupled to a connection line between the pressurized finishing liquid supply means (45–48) and said nozzle (38, 73) for, selectively, heating or cooling the liquor to be atomized.

26. The apparatus of claim 17, further including a collecting device (17, 51) coupled to the vessel (3) for collecting liquor separated from the aerosol;

and means (54, 55) for returning and recycling liquor collected in said collecting device to the pressurized finishing liquid supply means (45) for reintroduction thereof into the vessel and re-atomization therein for forming the aerosol in combination with the pressurized gas in the vessel.

* * * * *